United States Patent [19]

Swackhamer

[11] 4,112,156

[45] Sep. 5, 1978

[54] MAGNETIC TONER RECOVERY METHOD USING ALTERNATING MAGNETIC FIELD POLARITIES

[75] Inventor: Stanley B. Swackhamer, Pittsford, N.Y.

[73] Assignee: Xerox Corporation, Stamford, Conn.

[21] Appl. No.: 768,240

[22] Filed: Feb. 14, 1977

Related U.S. Application Data

[62] Division of Ser. No. 690,211, May 26, 1976, Pat. No. 4,043,298.

[51] Int. Cl.[2] ..... B05D 3/00

[52] U.S. Cl. ..... 427/444; 118/639; 209/213; 346/74.1; 427/12; 427/18; 427/47; 427/345

[58] Field of Search ..... 427/12, 14, 18, 20, 427/47, 48, 198, 345, 444; 118/70, 623, 639, 652; 346/153, 74.1; 355/15; 209/8, 223 R, 223 A

[56] References Cited

U.S. PATENT DOCUMENTS

| | | | |
|---|---|---|---|
| 3,333,572 | 8/1967 | Olden | 346/153 |
| 3,894,513 | 7/1975 | Stanley et al. | 118/652 |

OTHER PUBLICATIONS

Eastman Kodak Research Disclosure, Oct. 1974, p. 44; "Improved Magnetic Brush Cleaning System".

*Primary Examiner*—Ronald H. Smith
*Assistant Examiner*—Stuart D. Frenkel
*Attorney, Agent, or Firm*—James J. Ralabate; John E. Beck; George J. Cannon

[57] ABSTRACT

Airborne magnetic toner is recovered from the vicinity of a magnetizable recording medium by magnetically attracting the toner with a magnetic field which does not alternate in magnetic polarity thereby magnetically polarizing the toner; and, subsequently passing the polarized magnetic toner through a magnetic field which alternates in magnetic polarity thereby decreasing the magnetic polarization of the magnetic toner. This procedure maintains the flow characteristics of the toner and avoids the clumping together of toner normally associated with magnetic recovery of magnetic toner.

2 Claims, 2 Drawing Figures

MAGNETIC TONER RECOVERY METHOD USING ALTERNATING MAGNETIC FIELD POLARITIES

This is a division, of application Ser. No. 690,211, filed May 26, 1976 now U.S. Pat. No. 4,043,298, Aug. 23, 1977.

BACKGROUND OF THE INVENTION

This invention relates to airborne magnetic toner recovery; and, more particularly to demagnetizing magnetic tone which is recovered by magnetic scavenging.

There has recently been introduced a magnetic imaging system which employs a latent magnetic image on a magnetizable recording medium which can then be utilized for purposes such as electronic transmission or in a duplicating process by repetitive toning of the latent magnetic image with magnetic toner. Such magnetic imaging schemes are disclosed in U.S. Pat. Nos. 3,804,511 to Rait, et al; in 3,626,114; in 2,793,135 wherein a premagnetized surface is thermoremanently erased and in U.S. Pat. Nos. 3,611,415 and 3,368,209 wherein latent magnetic images are thermoremanently formed and developed.

Once the latent magnetic image is formed, it is developed with magnetic toner or developer material thereby being rendered visible. During development, some of the magnetic toner becomes airborne as the magnetic tape passes through the toner. The faster the tape speed, the more airborne toner there is.

One technique for removing airborne magnetic toner from the system is to magnetically attract the magnetic toner. This technique is referred to herein as magnetic scavenging. While this technique is quite efficient in the removal and recovery of magnetic toner, it does tend to polarize the toner; i.e., to permanently magnetize the toner.

As a consequence of this polarization of magnetic toner, the toner loses some of its flowability and tends to aggregate, agglomerate or clump together magnetically in the recovery process.

SUMMARY OF THE INVENTION

It is, therefore, an object of this invention to enhance the flow characteristics of magnetic toner in a magnetic scavenge recovery system.

It is another object of this invention to provide a novel magnetic toner scavenging system.

The foregoing objects and others are provided in accordance with the practice of the present invention by providing means for subjecting magnetic toner to a magnetic field alternating in magnetic polarity, in the flow path of recovered toner and between the magnetic scavenging member and the toner reservoir.

Magnetic toner polarized or magnetized by the magnetic scavenging member is passed through the alternating magnetic field and becomes de-magnetized, thereby increasing its flowability as measured by dynamic and static angle of repose measurements.

DETAILED DESCRIPTION OF THE PREFERRED EMBODIMENTS

Figure 1:
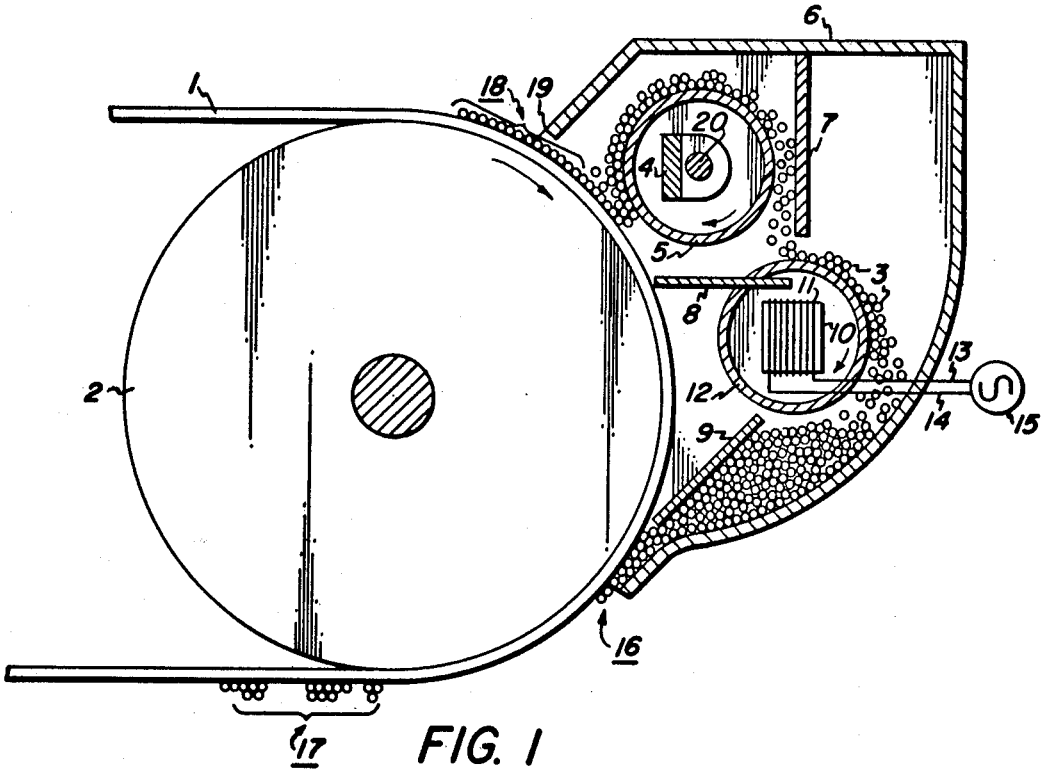
FIG. 1 is a partially schematic, partially cross-sectional view of an embodiment of the present invention.

Referring now to FIG. 1 there is seen airborne magnetic toner 18 following magnetizable recording medium 1 which is driven by drum 2 rotating in the direction indicated by the arrow of FIG. 1. Magnetizable recording medium 1 is shown as a web but can be a coating on drum 2 or on a planar member such as a flat sheet-like member. In the web embodiment magnetizable recording medium 1 is routed past one or more appropriate stations (not shown) where, utilizing conventional magnetic imaging techniques, a latent magnetic image is formed on medium 1.

For convenience of explanation, we now refer to opening 16 of developer housing 6 where particles of magnetic toner 3 are brought into contact with the surface of magnetizable recording medium 1 bearing the latent magnetic image. It is here that the latent magnetic image is developed, the magnetic toner particles 3 being attracted thereto by magnetic lines of force emanating therefrom. The developed image 17 now residing on magnetizable recording medium 1 is carried by the routing of medium 1 through various conventional stations.

The airborne toner which is desired to be removed from the vicinity of magnetizable recording medium 1 is depicted in FIG. 1 as 18. Before this toner is routed past the top edge 19 of developer housing 6, a large amount is removed by the magnetic attraction of stationary magnet 4 from medium 1 and attracted to rotating rotatable member 5. Stationary magnet 4 is mounted between the central longitudinal axis 20 of member 5 and the free surface of medium 1 within developer housing 6. This off-axis location of magnet 4 is combined with a north-south magnetic pole orientation of magnet 4 to assure that the magnetic lines of force extend to airborne toner 18 in sufficient strength to attract the toner to member 5 without preventing the removal by gravity of toner from member 5 upon rotation of member 5. That is, the magnetic lines of force around magnet 4 are oriented substantially from left to right horizontally in FIG. 1, extend to toner 18 but not to toner intermediate member 5 and baffle 7. It will be appreciated that magnet 4 can comprise a plurality of magnets aligned with like magnetic poles adjacent one another; i.e., north poles in alignment at one end and south magnetic poles in alignment at the other end.

Magnet(s) 4 constitute means for magnetically removing airborne toner from the vicinity of magnetizable recording medium 1. Rotatable member 5 constitutes means for removing toner from the magnetic influence of the means for magnetically removing toner from the vicinity of magnetizable recording medium 1. In lieu of member 5, the toner attracted to or by magnet 4 can be removed from its magnetic influence by other mechanical means such as, for example, a doctor blade or other scraper, a brush, etc., which will knock-off or remove toner from magnet 4. Alternatively, a shield and wiper assembly can be inserted intermediate magnet 4 and medium 1 to collect and brush off toner and thus remove it from the magnetic influence of magnet 4.

Once the toner passes through the magnetic field of magnet 4, it acquires magnetic polarity; i.e., it is magnetized. The extent of magnetization depends upon the strength of magnetic field to which it is subjected. However, any magnetic polarity or magnetization acquired by the magnetic toner will reduce its ability to flow to some extent and typically, such reduction in flowability is sufficiently troublesome to warrant correction. Otherwise, the behavior of toner within the proximity of opening 16 of developer housing 6 will be erratic due to magnetic clumping and the quality of developed image 17 will be unnecessarily low.

Therefore, the correction proposed herein relies upon the demagnetization of toner prior to its collection in the toner reservoir within housing 6. This demagnetization of magnetized toner is accomplished by passing the magnetized toner through an alternating magnetic field; i.e., a magnetic field in which the magnetic polarity of north and south poles is constantly changing from one polarity to the other.

As shown in FIG. 1, the electromagnet within rotatable member 12 comprises windings 11 wound about core 10. Windings 11 are connected to an alternating current source 15 by leads 13 and 14. It has been found that alternating current at a frequency as low as 60 Hz is sufficient to provide an alternating magnetic field which is effective to de-magnetize toner 3. Windings 11 are wound about core 10 in a longitudinal direction; i.e., into the plane of FIG. 1 and the resulting magnetic fields extend upwardly and downwardly of core 10 with respect to FIG. 1. Thus, the magnetic field lines of force are substantially in the direction of baffle 7 and substantially perpendicular to the flow of magnetic toner particles 3 on rotatable member 12.

In operation, airborne toner 18 is attracted by magnet 4 to the surface of rotating rotatable member 5 which carries the toner particles out of the influence of magnet 4 so that they are free to fall upon rotating member 12. Baffles 7 and 8 within developer housing 6 maintain the proper flow path of magnetic toner particles 30 under the influence of gravity upon rotating member 12. Rotating member 12 carries magnetic toner particles 3 through the alternating magnetic field set up by the alternating current electromagnet. Upon emergence from the alternating magnetic field, magnetic toner particles 3 are no longer magnetized and their flow characteristics are now substantially the same as those possessed upon original manufacture. In effect, the magnetic toner particles have the flow characteristics of fresh or new toner. When carried out of the influence of the alternating magnetic field by rotating member 12, magnetic toner particles 3 fall freely under the influence of gravity into the portion of developer housing 6 defined by baffle 9 and the opposing wall of housing 6. The "fresh" toner can now be re-employed for development.

Figure 2:
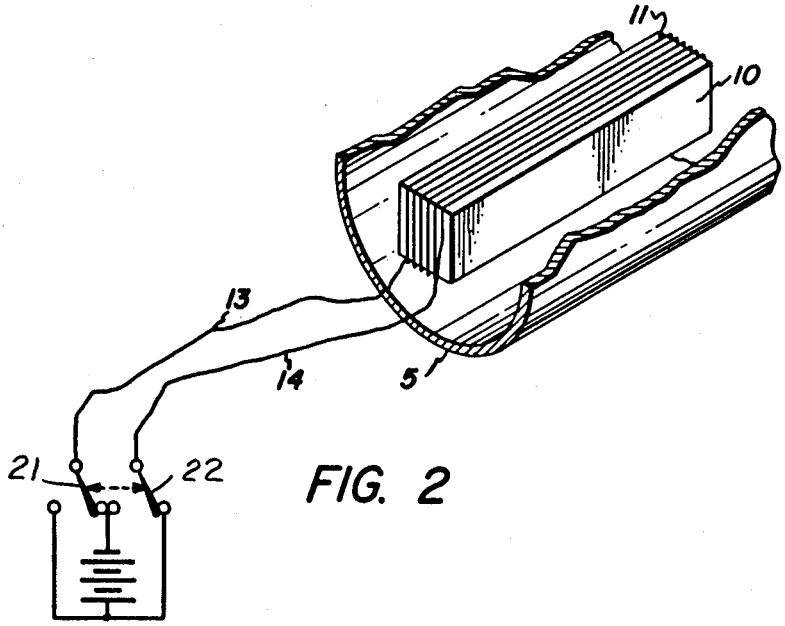
FIG. 2 is a schematic illustration of an alternate demagnetizing member comprising an alternating current electromagnet within a rotatable member.

As in the case of rotatable member 5, rotatable member 12 constitutes means for removing the magnetic toner particles from the influence of the alternating magnetic field. Any means other than rotatable member 12 can be utilized for this purpose and can constitute shields and wiper blades systems, brushes and the like. Also, the alternating magnetic field polarity electromagnet need not be electrically connected to a source of alternating current. The electromagnet can be connected by way of an oscillating switch or the like to a source of direct current the terminals of which may or may not be switched at predetermined intervals at leads 13 and 14. This latter variation for the alternating current electromagnet is schematically illustrated in FIG. 2. In FIG. 2, leads 13 and 14 are electrically connected by leaf members 21 and 22, in tandem, to opposite terminals of the DC source. The DC source can be an electrically or electronically controlled regulated power supply or simply a battery. Leafs 21 and 22 schematically illustrate the means for switching terminal connections of the DC source with leads 13 and 14. It will be understood that any suitable switch can be utilized and that any means for periodically actuating the switch can be utilized. For example, linkages, rods and cammed surfaces can be utilized to mechanically move a biased switch or, in the alternative, a solenoid plunger can be utilized to move a biased switch.

The frequency of the alternating magnetic field and hence the frequency of switching a DC current source or an alternating current source can be any frequency of about 60 Hz or greater. The magnitude of current flowing through windings 11 can be any level which produces a magnetic field strength upon magnetic toner particles 3 in housing 6 which effective to de-magnetize the toner particles. In this regard, the following information is given as an illustration of both the effects of alternating magnetic field upon magnetized magnetic toner with respect to static and dynamic angle of repose and the alternating magnetic field strength which is effective for the particular toner utilized.

EXAMPLES 70 cubic centimeters of magnetic toner available from Surface Processes, Inc. of Pennsylvania under the trademark MAGNAFAX 611, and subsequently treated with about 1.6% by weight of Silonox 101, a trademark from a fumed silicate available from Cabot Corporation, was utilized to determine the static and dynamic angle of repose of the treated toner. The average static angle of repose for 10 measurements was 43.2° and the average dynamic angle of repose for 10 measurements was about 11.2°.

The toner was next subjected to a non-alternating magnetic field having a strength of about 450 Gauss. This magnetic field simulates the magnetic scavenging magnet 4 of FIG. 1. The exposed magnetic toner became magnetized. The static and dynamic angle of repose for the exposed and and magnetized magnetic toner was then determined. For 10 measurements for each angle, the average dynamic angle of repose was determined to be about 31.5° and the average static angle of repose was determined to be about 46.9°. The about three fold increase in the dynamic angle of repose indicates the large extent of degradation in flow characteristics caused the exposure of the magnetic toner to the non-alternating magnetic field of about 450 Gauss.

Next, the magnetized magnetic toner was exposed to an alternating magnetic field, alternating at a frequency of about 60 Hz and having a field strength of about 1000 Gauss. Then, the dynamic and static angle of repose was measured for the magnetic toner. For 10 measurements for each angle, the dynamic angle of repose is about 12.9° and the average static angle of repose is about 43.4°.

It is seen, therefore, that treatment of magnetized magnetic toner particles with an alternating magnetic field can substantially restore the original flow characteristics to the magnetic toner. In this manner the magnetized magnetic toner particles can be returned to their original or "fresh" state of flow characteristics.

It will be appreciated that other variations and modifications will appear to those skilled in the art upon a reading of the present disclosure. These are intended to be within the scope of the invention.

What is claimed is:

1. A method for recovering airborne toner from the vicinity of a magnetizable recording medium, comprising: magnetically attracting airborne magnetic toner with a magnetic field which does not alternate in magnetic polarity thereby magnetically polarizing said magnetic toner; and passing said polarized magnetic toner through a magnetic field which alternates in magnetic polarity thereby decreasing the magnetic polarization of said magnetic toner.

2. The method of claim 1 wherein the frequency of alternation in magnetic polarity is at least about 60 Hz.

* * * * *